US006819769B1

(12) United States Patent
Zimmermann

(10) Patent No.: US 6,819,769 B1
(45) Date of Patent: Nov. 16, 2004

(54) ELECTROLYTIC LOUDSPEAKER ASSEMBLY

(76) Inventor: Claus Zimmermann, 1000 Business Center Cir. Thousand Oaks Business Center, Suite 107, Newbury Park, CA (US) 91320

( * ) Notice: Subject to any disclaimer, the term of this patent is extended or adjusted under 35 U.S.C. 154(b) by 0 days.

(21) Appl. No.: 09/445,041

(22) PCT Filed: Jun. 2, 1998

(86) PCT No.: PCT/US98/11275

§ 371 (c)(1),
(2), (4) Date: Dec. 1, 1999

(87) PCT Pub. No.: WO98/57522

PCT Pub. Date: Dec. 17, 1998

Related U.S. Application Data

(60) Provisional application No. 60/048,201, filed on Jun. 2, 1997.

(51) Int. Cl.[7] ..... H04R 25/00

(52) U.S. Cl. ..... 381/152; 381/190; 381/431

(58) Field of Search ..... 381/191, 113, 381/173, 174, 152, 190, 431; 310/324, 311

(56) References Cited

U.S. PATENT DOCUMENTS 5,392,358 A * 2/1995 Driver ..... 381/191

* cited by examiner

*Primary Examiner*—Suhan Ni
(74) *Attorney, Agent, or Firm*—Albert O. Cota

(57) ABSTRACT

A compilation of improvements and modifications to U.S. Pat. No. 5,392,358 which discloses an electrolytic loudspeaker assembly (10) which reproduces a broad band of audio signals. The assembly (10) is comprised of a thin, non-magnetic capacitive transducer (12) which consists of compound diaphragm (14) that is further comprised of a center section (16), a front section (20) and a rear sect compound diaphragm (14) is enclosed by a frame assembly (32). The improvements and modifications to the assembly designs for a center section (16A, 18A); three designs each for a front section (20A, 24A, 28A) and a rear section (22A, 26A, 30A); three designs for a frame assembly (32A, 34A, 36A) and two designs for a transducer driver unit (46, 48). The basic design of the assembly (10) is also augmented by the addition of an acoustic wave diffuser, reflector, and absorbing assembly (40) and an acoustic baffle structure (44).

10 Claims, 9 Drawing Sheets

ELECTROLYTIC LOUDSPEAKER ASSEMBLY

This application claims the benefit of provisional application Ser. No. 60/048,201 file Jun. 2, 1997.

TECHNICAL FIELD

The invention pertains to the general field of loudspeakers and more particularly to improvements and modifications to an electrolytic loudspeaker assembly as disclosed in U.S. Pat. No. 5,392,358 which is assigned to MZX Corporation which is also the applicant of the instant application.

BACKGROUND ART

From the beginning of "high fidelity" audio systems, engineers have endeavored to develop loudspeakers that were relatively free from distortion and that had a frequency response which would allow all types of music from the simple to the intricate to be closely reproduced. Loudspeakers are categorized as being either magnetic, moving coil speakers or non-magnetic, electrostatic speakers/transducers. Due to the fact that the instant invention is categorized as electrostatic, this background art will focus on these types of loudspeakers.

Most conventional electrostatic speakers consist of a flexible center membrane or diaphragm having on each side a fixed electrode designed in the shape of a grid of wire. The wires are placed apart thereby enabling sound waves, which are generated by the movement of the flexible membrane, to be emitted. The wires are held within a dielectric insulation material and the flexible membrane is coated with a highly resistive material. The membrane is further suspended within an open-latticed frame between the electrode wires 50 that when operated, relatively small segments of the diaphragm vibrate as a result of the electrostatic fields acting upon the diaphragm.

Electrostatic transducer loudspeakers are considered to be superior in many respects over the moving-coil type of speakers. However they have received generally poor acceptance. This poor acceptance is a result of the mechanical complexity of some designs, low acoustic output, the requirement for a comparatively large radiating area, and a dependence upon the application of a relatively high d-c polarizing bias voltage between the flexible diaphragm and the wire grid electrodes. For example, a typical full range push-pull electrostatic speaker requires a bias voltage of 3500 volts d-c and a driving amplifier with a power capacity of from 60 to 100 watts. Additionally, electrostatic speakers are only able to capable reproduce the mid-range and higher audible frequencies. As a result of this it is usually necessary to utilize a bass speaker, which can be connected to the loudspeaker assembly or be a separate module, such as a sub-woofer.

To alleviate some of the above problems, transducers utilizing electrets as the diaphragm have been utilized. The electret diaphragm was thought to be permanently polarized or charged and therefore did not require a separate polarizing d-c voltage. However, these electrets have been found to be unsatisfactory for application as loudspeakers because they decay, at least to a first approximation, because the misalignment of the partially oriented dipoles is a random process.

A search of the prior art did not disclose any patents that read directly on the claims of the instant invention however the following U.S. patents were considered related:

| Pat. No. | INVENTOR | ISSUED |
|---|---|---|
| 5,392,358 | Driver | 21 Feb. 1995 |
| 4,160,882 | Driver | 10 July 1979 |
| 3,942,029 | Kawakami et al | 2 Mar. 1976 |
| 3,705,312 | Sessler et al | 5 Dec. 1971 |
| 3,345,469 | Rod | 3 Oct. 1967 |

The U.S. Pat No. 5,3?9,358 Driver patent discloses an improved electrolytic loudspeaker assembly that is designed to reproduce a broad band of audio signals. The loudspeaker assembly consists of a thin, non-magnetic capacitive transducer and a transducer driver unit. The transducer consists of a compound diaphragm further consisting of a vibratory center section having attached to each of its surfaces a respective front section and a back action. All three sections of the compound diaphragms are held captive by a frame assembly. The transducer is driven and controlled by the transducer driver unit which couples the audio signal to the transducer's front and back sections and supplies an unregulated, d-c bias voltage to the transducers center section.

The U.S. Pat. No. 4,160,882 Driver patent discloses an electrostatic transducer that functions as a loudspeaker. The transducer consists of two parallel diaphragms each consisting of two plastic sheets, having different charge carrying characteristics, that are sandwiched between an electrically conductive layer. The two diaphragms are separated by a centrally located perforated electrically conductive sheet and a dielectric material sandwiched between the conductive sheet and each diaphragm. The diaphragm's two electrically conductive layers are connected across the secondary winding of an audio transformer and the centered electrically conductive sheet is connected to the center tap of the transformer. Thus, when the transformer applied an audio signal the two diaphragms are driven in a push-pull relation to reproduce the audio.

The U.S. Pat. No. 3,942,0109 Kawakami et al patent discloses an electrostatic transducer that can be utilized as either a speaker or microphone. The transducer consists of a vibrating plate or electret diaphragm having a monocharge of positive or negative potential on its surface. The electret diaphragm is made of a thin polymer film that bonded to a support so that uniform tension exits. A pair of electrically conductive electrodes are brought in contact with opposite sides of the polymer films, arid an eletrostatic shield, such as a mesh, covers the surface of the two electrodes. A d-c voltage is time applied across the electrodes to allow the electret to heat to its curie temperature of 120° C. The electret is subsequently cooled to produce a quasi permanent state of electric polarization.

The U.S. Pat No. 3,705,312 electric patent discloses a method for preparing a thin-film electret. The method includes placing a thin polymer film between two electrodes together with a dielectric plate. A voltage of about 30 kev is then applied across the resulting sandwich of elements for about one minute at room temperature and at atmospheric pressure. The method Produces charge-densities which are greater by a factor of three than those previously reported.

The U.S. Pat No. 3,345,469 Rod patent discloses a loudspeaker that operates on electrostatic principles. The speaker consists of a centrally located movable diaphragm which is coated on both sides with a thin, flexible eletrically conductive layer. On each side of the diaphragm is located at least one hermetically sealed plastic dielectric sheet.

When air or other gas is trapped between the sheets and the diaphragm, a buffer zone is created. To each outer-most dielectric sheet is attached an electrode and to the centered conductive diaphragm is likewise attached an electrode. The two buffer electrodes are connected across the secondary winding of a step-up transformer and the diaphragm electrode is connected through a d-c voltage source to the centertap of the transformer. The transformer's primary winding is connected to the diaphragm driving signal that is derived from the signal input from a conventional low-impedance amplifier.

DISCLOSURE OF THE INVENTION

The improvements and modifications disclosed herein enhance the performance of the electrolytic loudspeaker assembly to better reproduce a broad band of the audible spectrum. The improvements and modifications further allow the loudspeaker assembly to maintain its relatively flat, non-magnetic and non-ferrous structure. Because of this flat structure the inventive electrolytic loudspeaker assembly can be placed or mounted in places that are normally unsuitable for conventional loudspeakers. The flattened design also allows the structure to be bent or curved, which further extends its mounting capabilities in locations such as a curved corner or to items such as a lamp shade. Additionally, as a result of its inherent low weight, the loudspeaker assembly is ideal for use in weight-critical environments such as in aircraft and spacecraft.

In its most basic design configuration, the electrolytic loudspeaker assembly consists of:

A. a capacitive transducer consisting of:
  a) a compound diaphragm further consisting of:
    (1) A center section having a first side and a second side. Attached to the first side is a front section and attached to the second side is a rear section,
    (2) A center electrode which is in electrical contact with the center section, a front electrode which is in electrical contact with the front section, and a rear electrode which is in electrical contact with the rear section,
  b) a frame assembly consisting of:
    (1) A front section having an inner surface and an outer surface,
    (2) A rear Section having an inner surface and an outer surface. Between the two inner surfaces is suspended the compound diaphragm, B. A transducer driver unit which interfaces with the compound diaphragm by means of the center, front and rear electrodes. The driver unit is designed to accept an incoming audio signal and to produce an alternating signal, analogous to the incoming audio signal, which drives the compound diaphragm.

The improvements to the center section, which functions as the primary vibratory element, are disclosed in two design configurations, each of which include the center electrode which attache to the transducer driver unit. The front and back sections, which attach to the respective sides of the center section, are disclosed in three design configurations. Each section includes a front and rear electrode respectively which are also attached to the transducer driver unit. Likewise, the frame assembly which encloses the compound diaphragm to form the capacitive transducer is disclosed in three design configurations.

The capacitive transducer, in electrical terms, resembles a pair of double anode diodes connected in series or a uni-junction transistor. The compound diaphragm of the capacitive transducer is driven and controlled by the transducer driver unit which is disclosed in two design configurations.

In view of the above disclosure, it is the primary object of the invention to add improvements and to provide modifications which enhance the performance of the basic electrolytic loudspeaker assembly. It is also an object of the invention to provide an electrolytic loudspeaker assembly that:

is highly reliable and easily maintained, can be designed to fit in a particular space requirement, does not require the high signal and bias voltage needed to operate conventional electrostatic speakers, can be mounted in various positions and locations that are not possible with current magnetic moving-coil speakers and electrostatic speakers, and is cost effective from both a consumer's and manufacturer's point of view.

These and other objects and advantages of the present invention will become apparent from the subsequent detailed description of the preferred embodiment and the claims taken in conjunction with the accompanying drawings.

REST MODE FOP CARRYING OUT THE INVENTION

Figure 1:
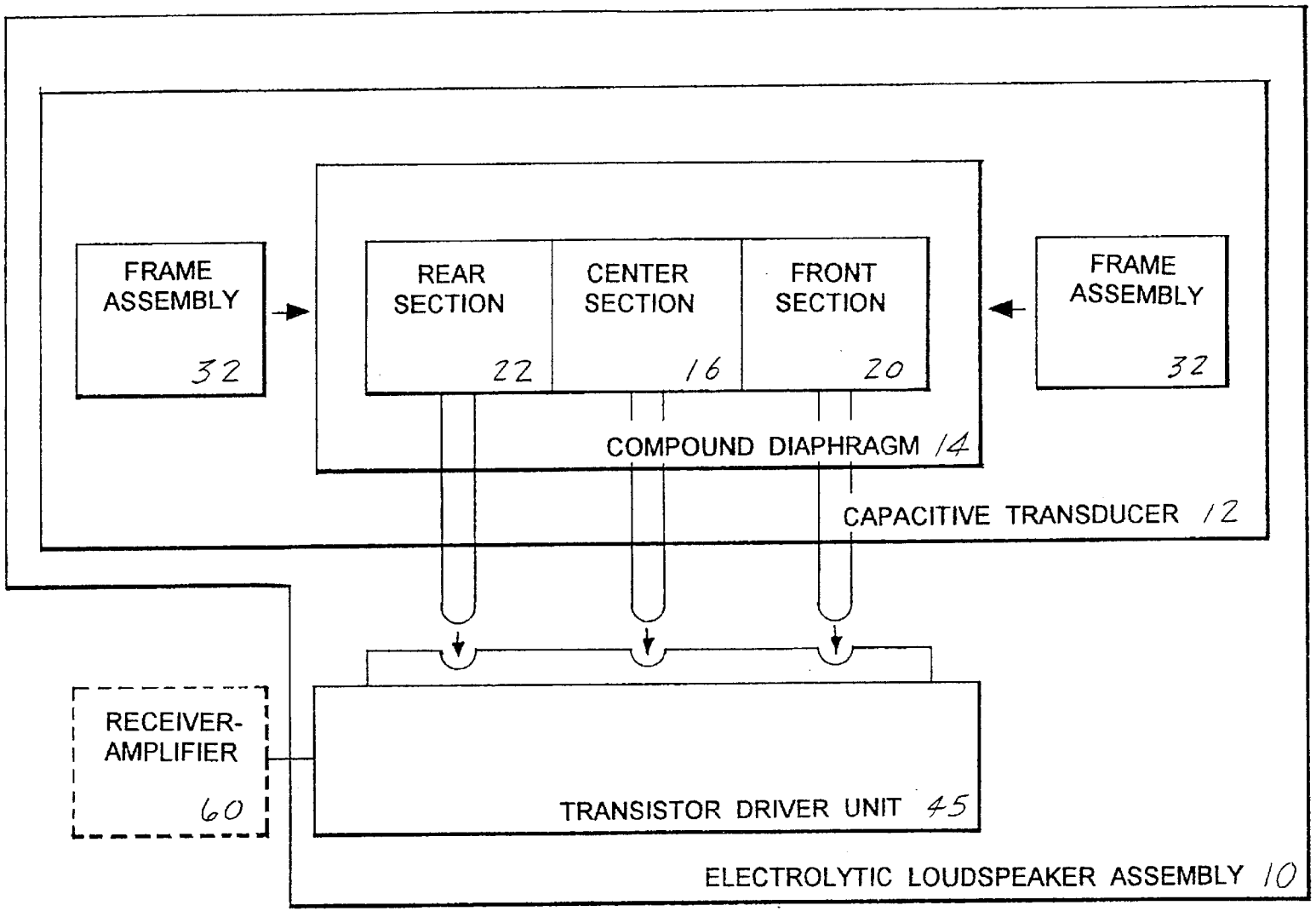
FIG. 1 is a block diagram of the electrolytic loudspeaker assembly.

The best mode for carrying out the invention is presented in terms of a generic design for an electrolytic loudspeaker assembly 10 which is comprised, as shown in FIG. 1, of two major elements: a capacitive transducer 12 and a transducer driver unit 46. The capacitive transducer 12 further consists of a compound diaphragm 14 which comprises a center section 16, a front section 20, a rear section 22, and a frame assembly 32. The electrolytic loudspeaker assembly 10 functions in combination with an audio receiver-amplifier 60 as shown in broken lines in FIG. 1.

Figure 2:
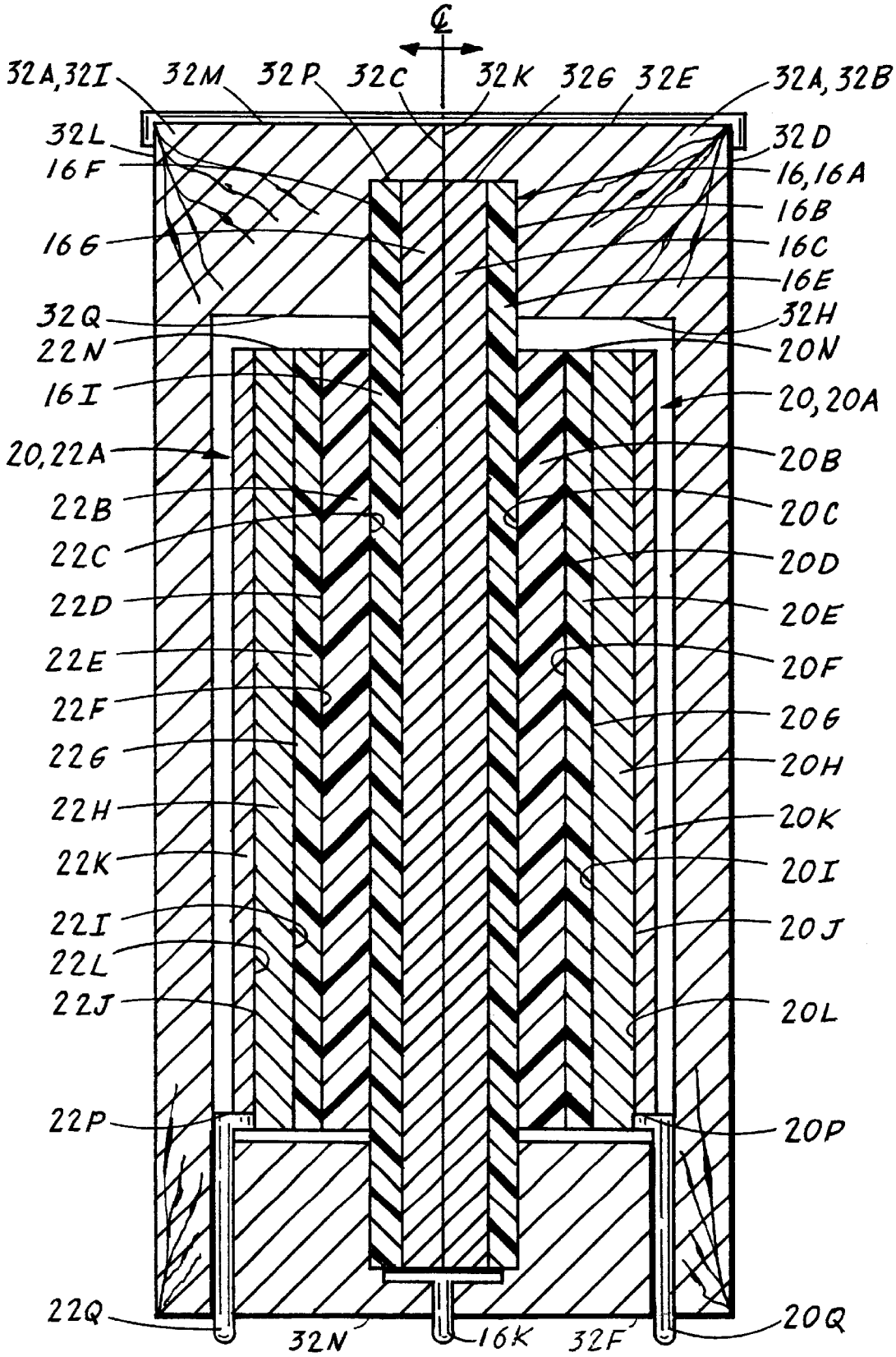
FIG. 2 is an elevational-sectional view of a capacitive transducer which consists of a first center section, a first front section, a first rear section and a first frame assembly.

The center section 16 is further disclosed in two design configurations: a first center section 16A and a second center section 18A. The first center section 16A, as shown in FIGS. 1 and 2, is comprised of a first side 16B, a second side 16F, and a center electrode 16K.

The first side 16B consists of a first metallized film 16C that faces inward and a non-metallized surface 16E that faces outward.

The second side 16F consists of a second metallized film 16G that faces inward and a non-metallized surface 16I that faces outward. The first metallized film 16C and the second metallized film 16G are in direct contact.

The center electrode 16K, which is in electrical contact with the first and second metallized films 16C,16G, enables the first center section 16A to make electrical contact with the transducer driver unit 46 as shown in FIG. 1.

The second side 16F consists of a second metallized film 16C having a metallized surface 16H that faces inward and a non-metallized surface 16I that faces outward. The metallized surface 16D of the first metallized film 16C and the metallized surface 16H of the second metallized film 16G are in direct contact.

The center electrode 160K, which is in electrical contact with the first and second metallized films 16C,16G, enables the first center section 16A to make electrical contact with the transducer driver unit 30 as shown in FIG. 1.

Figure 3:
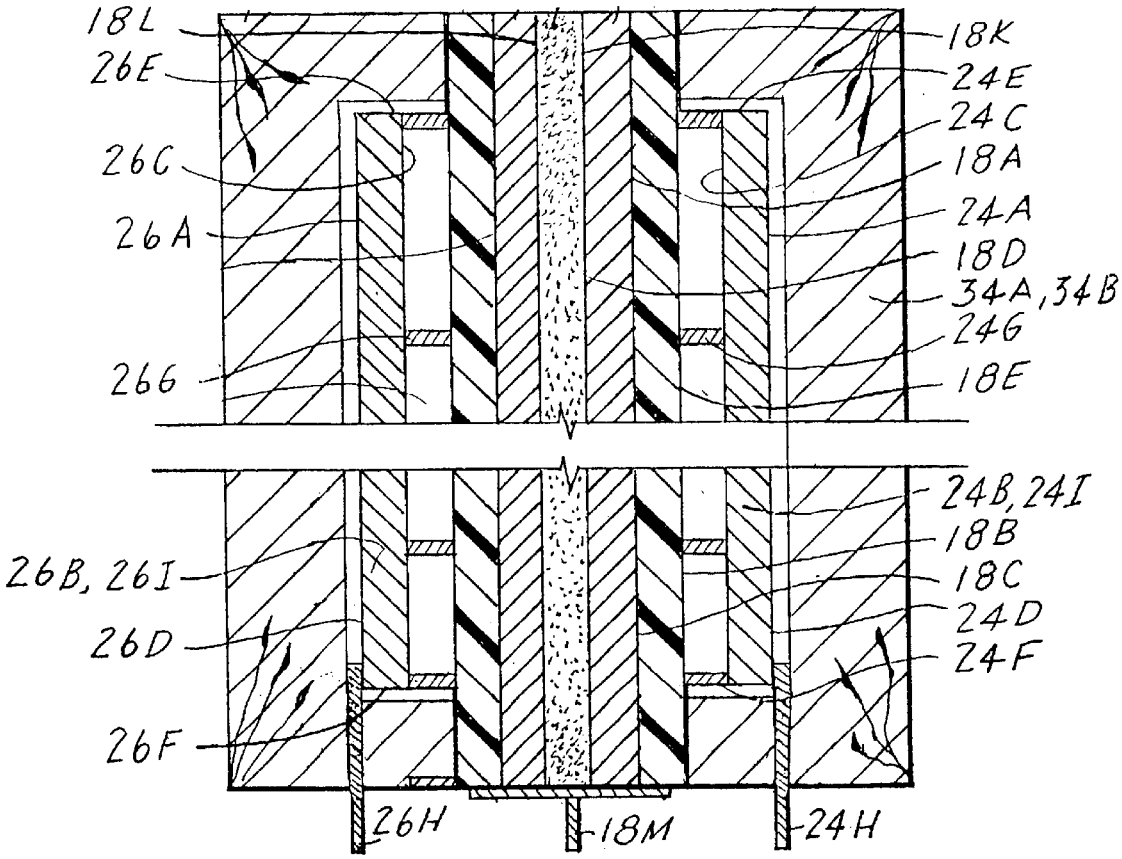
FIG. 3 is an elevational-sectional view of a capacitive transducer which consists of a second center section, a second front section, a second rear section and a second frame assembly.
Figure 5:
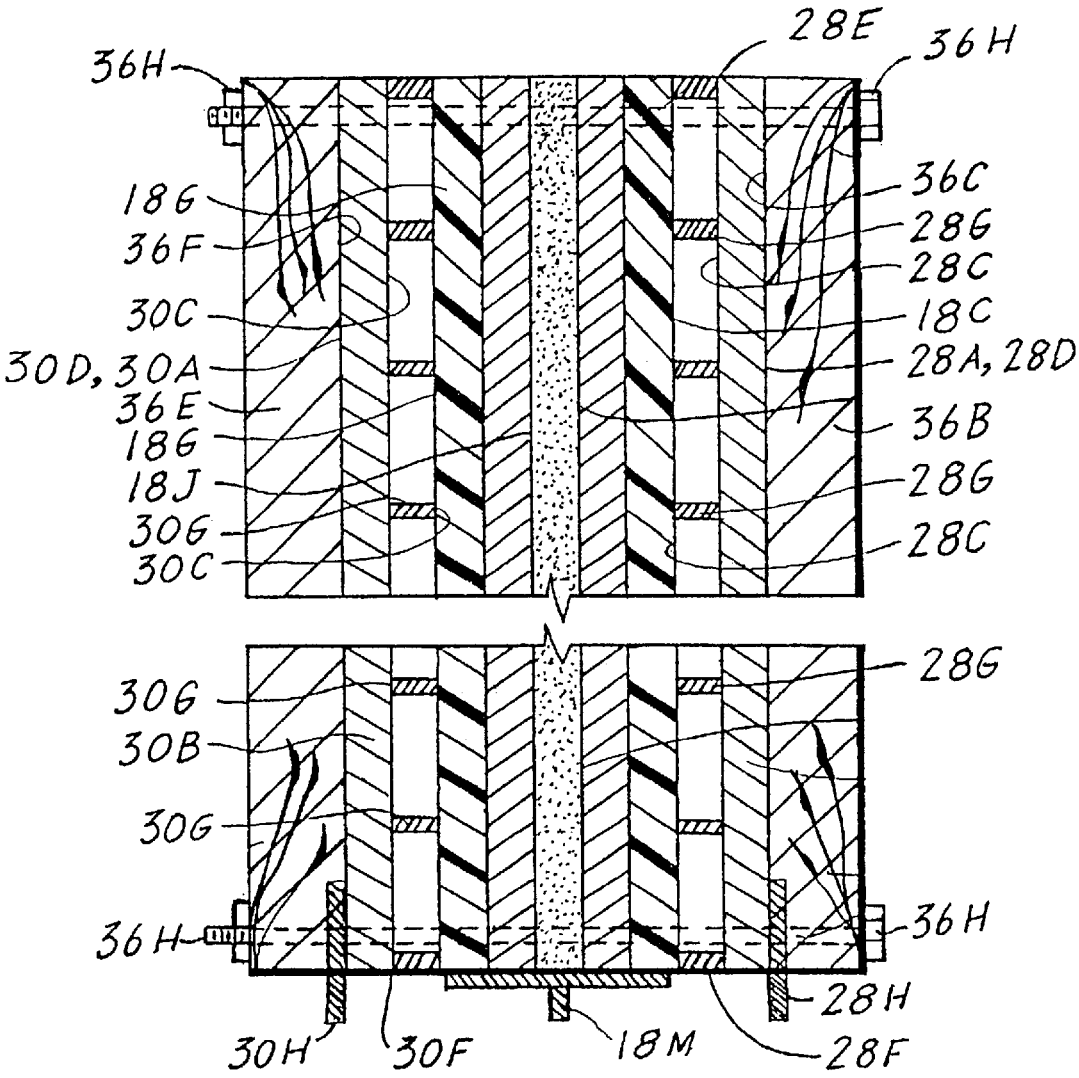
FIG. 5 is an elevational-sectional view of a capacitive transducer which consists of a second center section, a third front section, a third rear section and a third frame assembly.

The second center section 18A, as shown in FIGS. 1, 3 and 5, is comprised of a first side 18B, a second side 18F, a central resilient material 18J, and a center electrode 18M. The first side 18B consists of a first metallized film 18C having a metallized surface 18D that faces inward and a non-metallized surface 18E that faces outward. The second side 18F consists of a second metallized film 18G having a metallized surface 18H that faces inward and a non-metallized surface 18I that faces outward.

The central resilient material 18J includes a front side 18K and a rear side 18L. The metallized surface 18D of the first metallized film 18C is in direct contact with the front side 18K and the metallized surface 18H of the second metallized film 18G is in direct contact with the rear side 18L. The center electrode 18M which is in electrical contact with the first and second metallized films 18L, 18G enables the second center section 18A makes electrical contact with the transducer driver 30 as shown in FIG. 1.

The front section 20 and the rear section 22 are further disclosed in three design configurations: a first front section 20A, a first rear section 22A, a second front section 24A, a second rear section 26A, a third front section 28A and a third rear section 30A.

The first front section 20A, as shown in FIGS. 1 and 2, is comprised of a first dielectric spacer 20B, an insulating layer 20E, a conductive layer 20H, a first grid 20K, and a front electrode 20Q.

The first dielectric spacer 20B, which includes an inner surface 20C and an outer surface 20D, is constructed of a non-conductive material such as plastic and includes a spacer pattern. The insulating layer 20E includes a first side 20F and a second side 20G and is constructed of a high-dielectric compound such as TEFLON(®) or a corona spray. The first side 20F of the insulating layer 20E is in contact with the outer surface 20D of the first dielectric spacer 20B. In contact with the second side 20G of the insulating layer 20E is the inner surface 20I of the conductive layer 20H. To the outer surface 20J of the conductive layer 20H is attached the inner surface 20J of the first grid 20K. The conductive layer 20L is constructed of an angstrom thickness coating of silver or aluminum, which is applied by a vacuum deposition process by a rolling or by a spraying apparatus. Attached to the lower edge 20P of the first grid 20K and in contact with the conductive layer 20H is the front electrode 20Q.

The first rear section 22A is similar to the first front section 20A and is also shown in FIGS. 1 and 2. The section 22A is comprised of a second dielectric spacer 22B an insulating layer 22E, a conductive layer 22H, a second grid 22K, and a rear electrode 22Q.

The second dielectric spacer 22B which includes an inner surface 220 and an outer surface 22D, is constructed of a non-conductive material such as plastic and includes a spacer pattern. The insulating layer 22E includes a first side 22F and a second side 22G and is also constructed of a high-dielectric compound such as TEFLON (®) or a corona spray. The first side 22F of the insulating layer ACE is in contact with the outer surface 22D of the second dielectric spacer 22B. In contact with the second side 22G of the insulating layer 22E is the inner surface 22I of the conductive layer 22H. To the outer surface 22J of the conductive layer 22H is attached the inner surface 22L of the second grid 22K. The conductive layer 22H is also constructed of an angstrom thickness coating of silver or aluminum, which is applied by a vacuum deposition process, by a rolling or by a spraying apparatus. Attached to the lower edge 22P of the second grid 22K and in contact with the conductive layer 22H is the rear electrode 22Q The first rear section 22A is similar to the first front section 20A and is also shown in FIGS. 1 and 2. The section 22A is comprised of a second dielectric spacer 22B an insulating layer 22E, a conductive layer 22H, a second grid 22K, and a rear electrode 22Q.

The second dielectric spacer 22B which includes an inner surface 22C and an outer surface 22D, is constructed of a non-conductive material such as plastic and includes a spacer pattern. The insulating layer 22E includes a first side 22F and a second side 22G and is also constructed of a high-dielectric compound such as TEFLON (®) or a corona spray. The first side 22F of the insulating layer ACE is in contact with the outer surface 22D of the second dielectric spacer 22B. In contact with the second side 22G of the insulating layer 22E is the inner surface 22I of the conductive layer 22H. To the outer surface 22J of the conductive layer 22H is attached the inner surface 22L of the second grid 22K. The conductive layer 22H is also constructed of an angstrom thickness coating of silver or aluminum, which is applied by a vacuum deposition process, by a rolling or by a spraying apparatus. Attached to the lower edge 22P of the second grid 22K and in contact with the conductive layer 22H is the rear electrode 22Q The second front section 24A as shown in FIGS. 1 and 3, is comprised of a perforated first grid 24 an air gap structure 24G and a front electrode 24H.

The perforated first grid 24B includes an inner side 24C, an outer side 24D, an upper edge 24E and a lower edge 24F. The first grid 24D is constructed of a metal or plastic material, and may have a thickness of between 16 to 28 gauge and incorporates a perforated pattern. The inner side 24C of the first grid 24B is separated from the second center section 18A by an air gap structure 24G and the outer side 24D is free standing as shown in FIG. 3.

Figure 4:
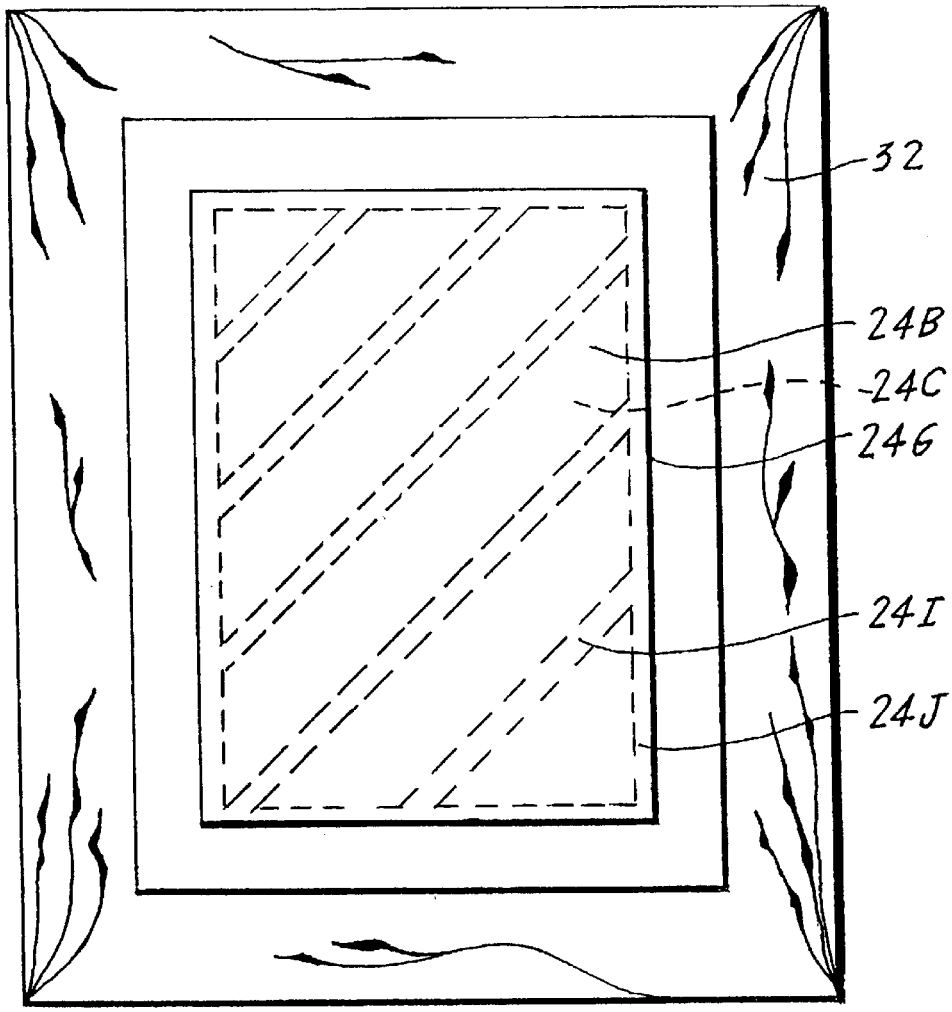
FIG. 4 is an elevational front view of a typical air gap structure having 45° angular spacers contained within a supporting border.

The air gap structure 24G, as shown in FIG. 4 is typically constructed of an insulating material and can incorporate various spacer designs. These designs may consist of a structure having a multiplicity of openings vertical spacers, horizontal spacers and/or angular spacers. A typical structure 24G having 45° angular spacers 24I with a supporting border 24J is shown in FIG. 4.

The second rear section 26A as shown in FIGS. 1 and 3, is structurally identical to the second front section 24A and is comprised of a perforated first grid 26B, an air gap structure 26G and a rear electrode 26H.

The perforated first grid 26B includes an inner side 26B, an outer side 260, an upper edge 26E and a lower edge 26F. The second grid 26B is also constructed of a metal or a plastic material, has a thickness of between 16 to 28 gauge and incorporates a perforated pattern. The inner side 26C of the second grid 24B is separated from the second center section 18A by an air gap structure 26G and the outer side 24D is free standing as shown in FIG. 3.

The air gap structure 24C, as also shown in FIG. 4 is typically constructed of an insulating material and can incorporate various spacer designs as is disclosed above for the second front section.

The third front section 28A as shown in FIGS. 1 and 5, is comprised of a perforated first grid 28B which includes an inner side 28C, an outer side 28D, an upper edge 28E and a lower edge 28F. The grid 28B is comprised of a multiplicity of bores which are preferably angled outward from a perpendicular reference. This angular bore displacement provides increased dispersion of the front wave and more efficient rear wave management.

The inner side 28C of the grid 28B, as shown in FIG. 5, is separated from the second center section 18A by an air gap structure 28G. The structure 28G is constructed of an insulating material which can incorporate various combinations of spacer designs. As also shown in FIG. 5, the third front section 28A has a length which is substantially equal to the length of the second center section 18A. To complete the third front section a front electrode 28H is attached to the lower edge 28F of the first grid 28B.

The third rear section 30A, as also shown in FIG. 5, has a similar construction on the third rear section 28A and is comprised of a perforated second grid 30B which includes an inner side 300, an outer side 30D, an upper edge 30E and a lower edge 30F. As in the third front section 28A the third rear section 30A is also separated from the second center section 18A by an air gap structure 30C, has a length equal to the length of the second center section 18A and from the lower edge 30F extends a rear electrode 30H.

To complete the structure of the capacitive transducer 12, the frame assembly 32 is utilized, which is disclosed in three design configurations.

The first frame assembly 32A, as shown in FIG. 2, is comprised of a front section 32B and a rear section 32I both of which can be constructed of a metal, such as aluminum, or a wood or a plastic. The front section 32B includes an inner surface 32C, an outer surface 32D, an upper portion 32E and a lower portion 32F. The upper portion 32E and the lower portion 32F are each configured to include an inward facing first step 32G and a contiguous inward facing second step 32H.

The rear section 32I also includes an inner surface 32K, an outer surface 32L, an upper portion 32M and a lower portion 32N. The upper portion 32M and the lower portion 32L are also each configured to include a complimentary inward facing first step 32P and a contiguous inward facing second step 320. The first step 32G of the front section 32B is dimensioned to abut the first step 32P of the rear section 32I and the second step 32H and 32Q of the front and rear sections to abut with the respective first side 16B and second side 16F 18F of the first center section 16A. When the front and rear sections 32B and 32I are attached the compound diaphragm 14 is formed which allows it to freely move forward and backward in synchrony with a set of impressed audio sound waves.

The second frame assembly 34A, as shown in FIG. 3, is comprised of a front section 34B, a rear section 34G both of which can be constructed of a metal, or a wood or a plastic. The front section 34B include an inner surface 340 and an outer surface 34D. The inner surface 34C is configured in an inverted C-section 34E. The two ends of the inverted C-section 34E are attached to the respective ends of the second center section 18A.

The rear section 34G also includes an inner surface 34H and an outer surface 34I. The inner surface 34H is configured in a C-section 34J Wherein the ends of the C-section 34J are attached to the respective ends of the second center section 18A. When the front and rear sections 34B,34C are attached, the compound diaphragm is formed.

The third frame assemble, 36A, as shown in FIG. 5, is comprised of a front section 369 and a rear section 36E. The front section 36B includes an inner surface 36C and an outer surface 36D. The inner surface 36C is pressed against the perimeter of the outward side 28D of the perforated first grid 28B of the third front section 28A.

The rear section 36E also includes an inner surface 36F and an outer surface 36G. The inner surface 36F is pressed against the perimeter of the outward side 30D of the perforated second grid 30B of the third rear section 30A. The front and rear sections 36B, 36E of the third frame assembly 36A are held against the compound diaphragm 14, by an attachment means which preferably consists of a plurality of non-conductive bolt and nut combinations 36H. Once attached, the compound diaphragm 14 is free to move in synchrony with a set of impressed audio sound waves.

To enhance the clarity and performance of the electrolytic loudspeaker assembly 10, an acoustic wave diffuser, reflector and absorbing assembly 40 can be utilized. The assembly 40 which is designed to be attached to the rear surface of a wall mounted electrolytic loudspeaker assembly 10, functions by performing two steps.

In the first step, the assembly 40 simultaneously increase, the distribution of and modifies the direction of the acoustic waves without loss of energy from the spatial response area.

In the second step, the diffused sound energy is distributed in time within the spatial response area. Thus, an expanded listening space is perceived by the listener, which adds to the realism of the audio.

Figure 6:
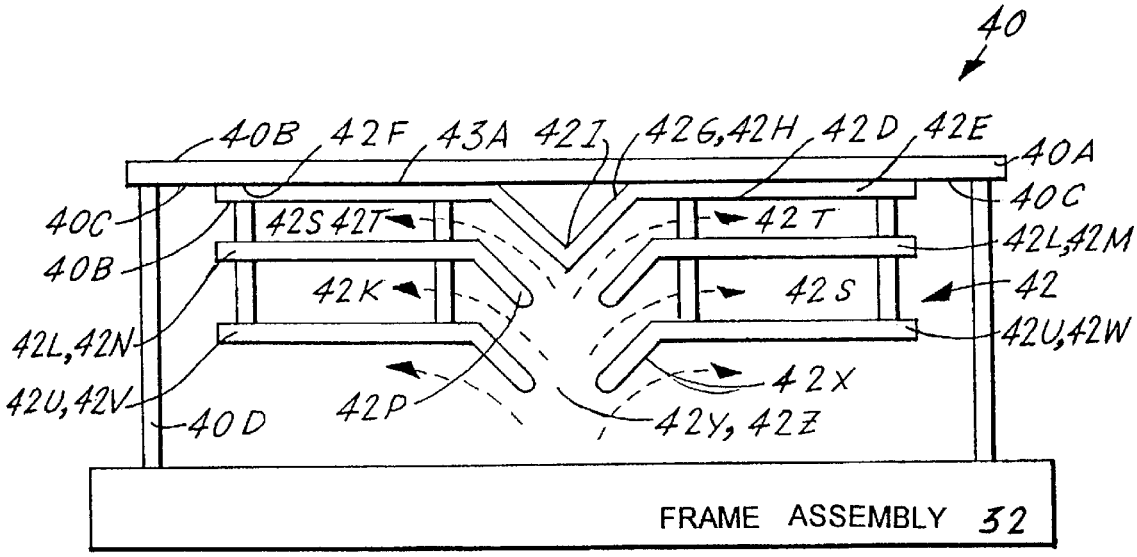
FIG. 6 is a top plan view of an acoustic wave diffuser, reflector and absorbing assembly.
Figure 7:
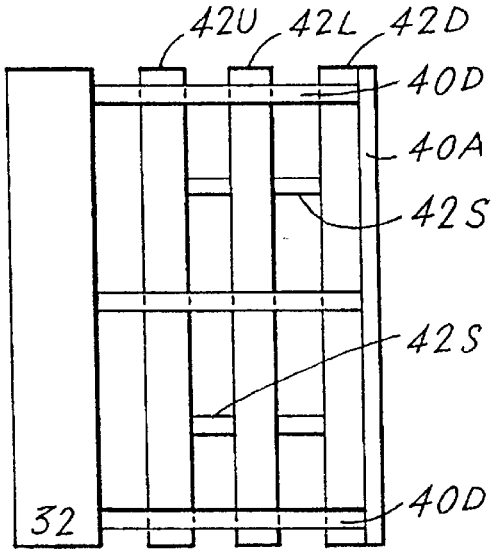
FIG. 7 is a side elevational view of the acoustic wave diffuser, reflector and absorbing assembly.
Figure 8:
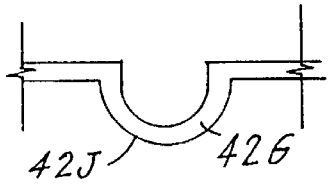
FIG. 8 is a top plan view of an inward-protruding central section which has a convex shape and is located on a rear acoustic wave guide of the acoustic wave diffusing, reflecting and absorbing structure.

The assembly 40, as shown in FIGS. 6, 7 and 8 is comprised of a base plate 40A and an acoustic wave diffusing, reflecting and absorbing structure 42. The assembly 40 is dimensioned to substantially cover the entire rear section of the first, second or third frame assemblies 32A, 34A, 30A.

The base plate 40A has an outer surface 40B and an inner surface 40C. The inner surface 40C is attached to the rear section of the frame assembly by a plurality of standoffs 40D. When the base plate 40A is attached, a space remains between the inner surface 40C of the base plate and the outer surface of the rear section of the frame assembly as shown in FIG. 6.

The acoustic wave diffusing, reflecting and absorbing structure 42 is located and attached in the space between the base plate 40A and the frame assembly. The structure 42 includes a plurality of acoustic wave guides each having an entrance port and an exit port. The sound wave guides are arranged to allow the acoustic waves emitted from the rear of the electrolytic loudspeaker assembly 10 to be guided through the entrance port and out the exit port. In the preferred embodiment, the acoustic wave diffusing, reflecting and absorbing structure 42 is comprised of a rear sound wave guide 42D, a center acoustic wave guide 42L and a front acoustic wave guide 42U.

The rear acoustic wave guide 42D has a first side section 42E, a second side section 42F, an outer surface 43A, an inner surface 43B and an integral and closed center section 42G which protrudes inward. The outer surface 43A is attached, by an attachment means, to the inner surface 40C of the base plate 40A. Preferably, the closed center section 42C has a triangular shape 42H with an apex 42I that faces inward, as shown in FIG. 6. Alternatively, the closed center section 4G can have a convex shape 42J as shown in FIG. 8. Ultimately, the geometry of the structure 42 is dependent upon and tailored to the specific configuration of the electrolytic loudspeaker assembly 10.

The center acoustic wave guide 42L has a first side section 42M, a second side section 42N and an inward protruding central section 42P having a centered vertical slot 42G that functions as an entrance port 42R. The center acoustic wave guide 42L is attached to the rear acoustic wave guide 42D by a plurality of standoffs 42S to allow an exit port 42T to be created on each side.

The front acoustic wave guide 42U has a first side section 42V a second side section 42W and an inward protruding central section 42X having a centered vertical slot 42Y that functions as an entrance port 42Z. The front sound wave guide 42U is attached to the center sound wave guide 42L by a plurality of standoffs 42S which allow an exit port 42K to be created on each side. The acoustic wave guides are arranged to allow acoustic waves emanating from the electrolytic loudspeaker assembly 10 to be guided through the entrance ports and the exit ports of the structure 42.

In lieu of the acoustic wave diffuser, reflector and absorbing assembly 40, an acoustic baffle structure 44, as shown in FIGS. 9, 10, 11 and 12 can be used. The structure 44, which is designed to be attached to the rear section of the compound diaphragm 14, of the capacitive transducer 12, aids in controlling the acoustic waves emanating from the rear surface of the capacitive transducer 12.

Figure 9:
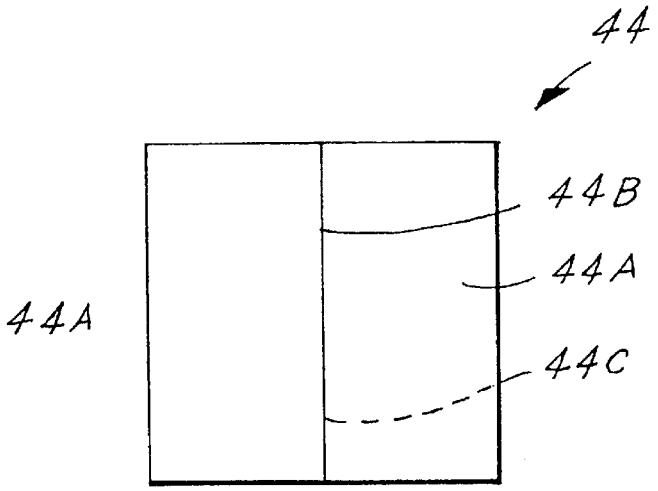
FIG. 9 is a rear elevational view of an acoustic baffle structure having two acoustic wave impinging baffles.
Figure 10:
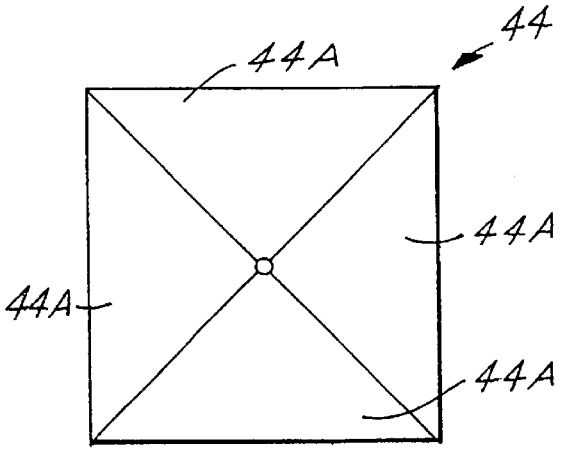
FIG. 10 is a rear elevational view of an acoustic baffle structure having four acoustic wave impinging baffles that extend outward from a centered apex.
Figure 11:
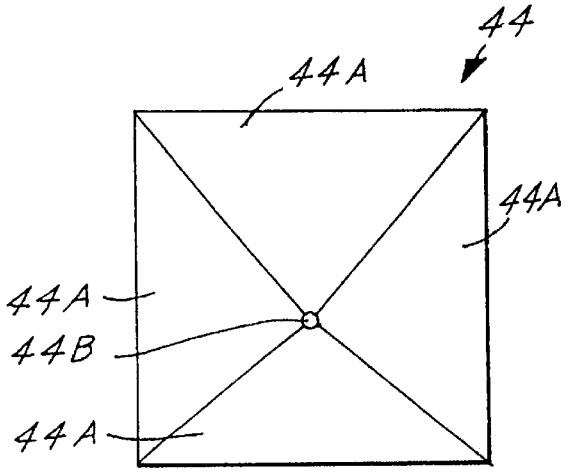
FIG. 11 is a rear elevational view of an acoustic baffle structure having four acoustic wave impinging baffles that extend outward from an off-centered apex.
Figure 12:
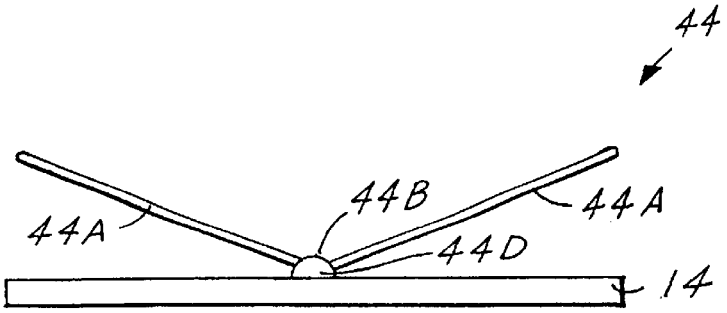
FIG. 12 is a top plan view of a pair of wave impinging baffles having an apex that is attached to a pivoting unit which allows the baffles to be located at selectable outward-extending angles.

In its most basic design, the structure 44, as shown in FIG. 9, has at least two acoustic wave impinging baffles 44A that converge outward from an apex 44B that is attached, by an attachment means 440, to the rear section of the compound diaphragm 14 of the capacitive transducer 12. When the acoustic waves emanating from the capacitive transducer 12 impinge upon the at least two baffles 44A they move outward into an audio listening space. The acoustic baffle structure 44 can also be designed to include four baffles 44A that e,extent outward from an apex 44B, as shown in FIGS. 10 and 11. The apex 44B can be centered on the rear section of the compound diaphragm 12, as shown in FIG. 10 or the baffle 44A can extend outward from an apex 44B which is located off-center on the rear section of the compound diaphragm 12 as shown in FIG. 11. The apex 44B can also be attached to a pivoting unit 44D which is attached to the rear section of the compound diaphragm 14 as shown in FIG. 12. In this design, the pivoting unit 44D allows the baffles 44A to be located at selectable outward extending angles.

The transducer driver unit 45 is disclosed in two design configurations: a first transducer driver unit 46 and a second transducer driver unit 48.

Figure 13:
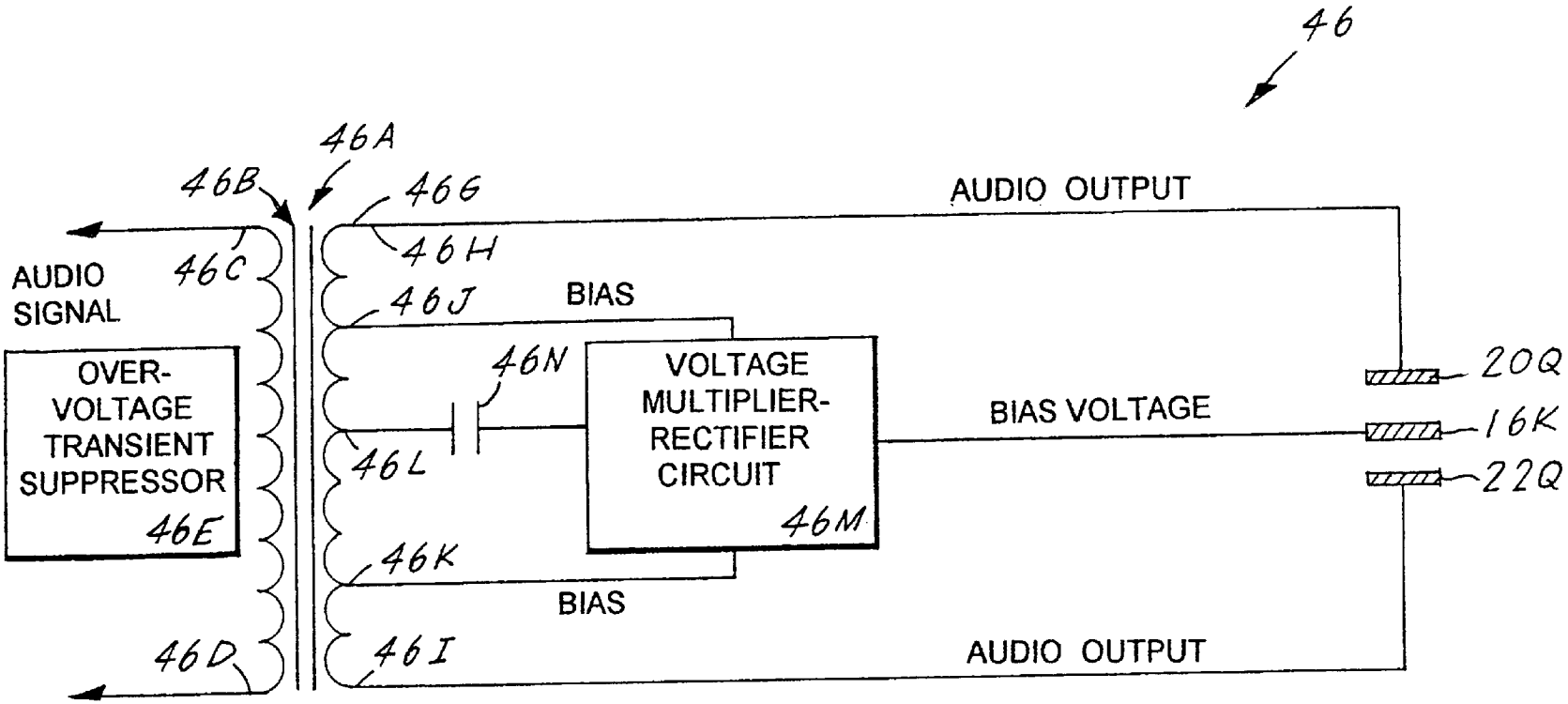
FIG. 13 is a combination block/schematic diagram of a transducer driver unit configured as a first transducer driver unit.

The first transducer driver unit 46, as shown in FIG. 13, is comprised of an audio transformer 46A having a primary winding 46B and a secondary winding 46G. The primary winding 46B includes a first terminal 46C and a second terminal 46D which are connected across an incoming audio signal. Across the terminals 46C and 46D may be connected an over-voltage transient suppressor 46E which preferably consists of a bi-directional zener diode.

The secondary winding 40G includes a third terminal 46H and a sixth terminal 46I from where an output audio signal is produced; a fourth terminal 46J and a fifth terminal 46K from where a bias voltage is produced; and a center tapped seventh terminal 46L.

The third terminal 46H is connected to the front electrode and the sixth terminal 46I is connected to the rear electrode.

The fourth terminal 46J is connected to a first stage of a multi-stage voltage multiplier-rectifier circuit 46M, the fifth terminal 46K is connected to an intermediate stage of the circuit 46M, and the seventh terminal 46L is connected through a capacitor 46N to a final stage of the circuit 46M. The output of the voltage tripler 46M is a bias voltage that is connected to the center electrode.

Figure 14:
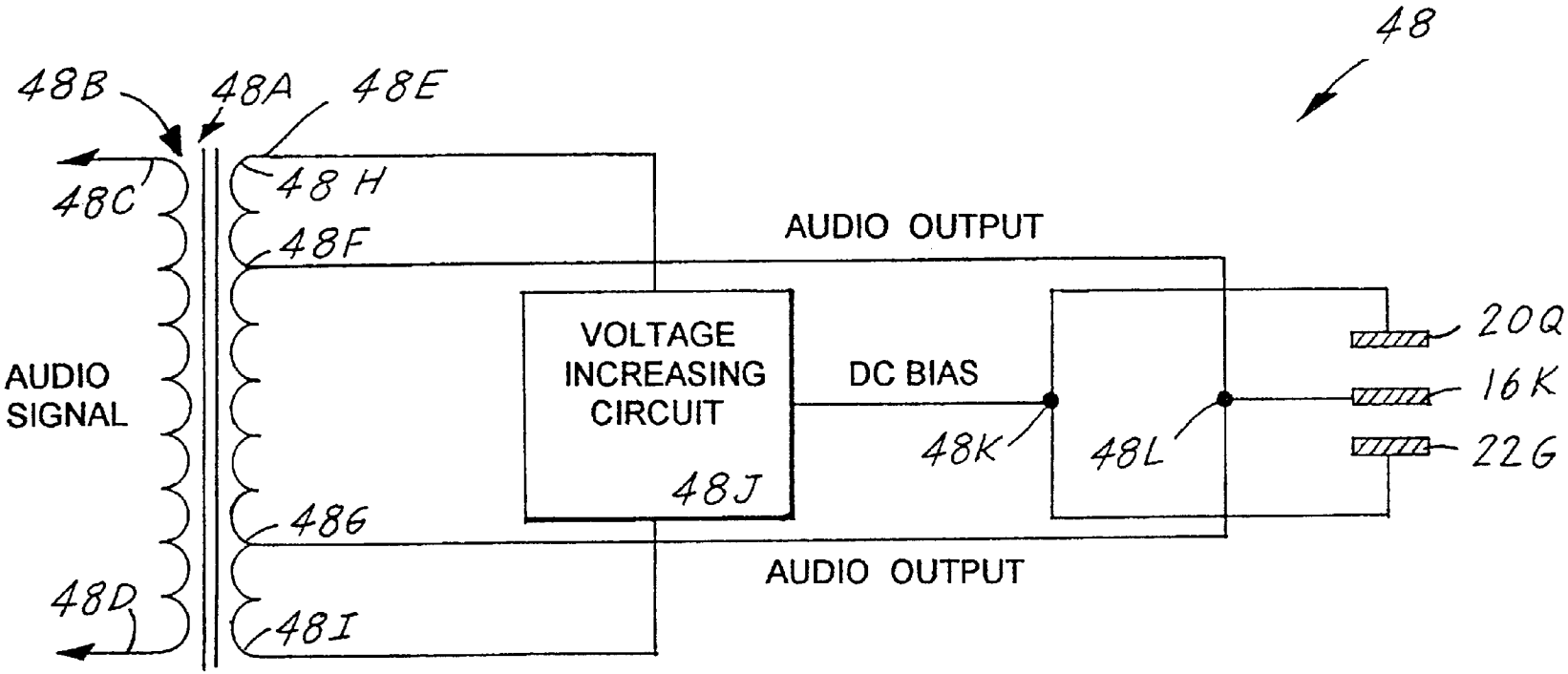
FIG. 14 is a combination block/schematic diagram of a transducer driver unit configured as a second transducer driver unit.

The second transducer driver unit 48 as shown in FIG. 14 is comprised of an audio transformer 48A having a primary winding 48B and a secondary winding 48E. The primary winding 48B includes a first terminal 48C and a second terminal 48D which are connected across an incoming audio signal.

The secondary winding 48E includes a fourth terminal 48F and a fifth terminal 48G from where an output audio signal is produced; and a third terminal 46H and a sixth terminal 48I from where a bias voltage is produced.

The third terminal 48H and the sixth terminal 48I are connected to a voltage-increasing circuit 48J that produces a d-c bias voltage which is coupled through a first junction 48K to the front and rear electrodes. The voltage enhancing circuit preferably consists of a multi-stage voltage multiplier-rectifier circuit. The fourth terminal 48F and the fifth terminal 48G are connected across a second junction 48L from where the audio signal is applied to the center electrode.

While the invention has been described in complete detail and pictorially shown in the accompanying drawings it is not to be limited to such details, since many changes and modifications may be made in the invention without departing from the spirit and scope therefore. Hence, it is described to cover any and all modifications and forms which may come within the language and scope of the appended claims.

What is claimed is:

1. An electrolytic loudspeaker assembly comprising:

A. a capacitive transducer comprising:

a) a compound diaphragm further comprising:

(1) a center section having a first a side and a second side, wherein attached to the first side is a front section and attached to the second side is a rear section, wherein said front section comprising:

(a) a first dielectric spacer having an inner surface and an outer surface, (b) an insulating layer having a first side and a second side, wherein the first side is in contact with the outer surface of said first dielectric spacer, (c) a conductive layer consists of an angstrom thickness coating of silver or aluminum having an inner surface and an outer surface, wherein the inner surface is in contact with the second side of said insulating layer, (d) a first grid having an inner surface, an outer surface, an upper edge and a lower edge, wherein the inner surface is in contact with the outer surface of said conductive layer and wherein from the lower edge extends the front electrode, (2) a center electrode in electrical contact with said center section, a front electrode in electrical contact with said front section, and a rear electrode in electrical contact with the rear section, b) a frame assembly comprising:

(1) a front section having an inner surface and an outer surface, (2) a rear section having an inner surface and an outer surface, wherein between the two inner surfaces is suspended said compound diaphragm, and B. a transducer driver unit which interfaces with said compound diaphragm by means of said center, front and rear electrodes, wherein said unit accepts an incoming audio signal and produces an alternating signal, analogous to the incoming audio signal, which drives said compound diaphragm.

2. The assembly as specified in claim 1 wherein said transducer driver unit is comprised of a first transducer driver unit comprising:

a) an audio transformer having a primary winding which includes a first terminal and a second terminal which are connected across arm incoming audio signal, and a secondary winding which includes a third and sixth terminal from where an output audio signal is produced, a fourth and fifth terminal from where a bias voltage is produced and a center tapped seventh terminal, b) wherein the third terminal is connected to said front electrode and the sixth terminal is connected to the rear electrode, and c) wherein the fourth terminal is connected to a first stage of a multi-stage voltage multiplier-rectifier circuit, the fifth terminal is connected to an intermediate stage of said circuit, and the seventh terminal is connected through a capacitor to a final stage of said circuit, wherein the output of said circuit is a bias voltage that is connected to said center electrode.

3. An electrolytic loudspeaker assembly comprising:

A. a capacitive transducer comprising:

a) a compound diaphragm further comprising:

(1) a center section having a first side and a second side, wherein attached to the first side is a front section and attached to the second side is a rear section, wherein said front section comprising:

(a) a first dielectric spacer having an inner surface and an outer surface, (b) an insulating layer having a first side and a second., side, wherein the first side is in contact with the outer surface of said first dielectric spacer, (c) a conductive layer consists of an angstrom thickness coating of a conductive material having an inner surface and an outer surface, wherein the inner surface is in contact with the second side of said insulating layer, (d) a first grid having an inner surface, an outer surface, an upper edge and a lower edge, wherein the inner surface is in contact with the outer surface of said conductive layer and wherein from the lower edge extends the front electrode, (2) a center electrode in electrical contact with said center section, a front electrode in electrical contact with said front section, and a rear electrode in electrical contact with the rear section, b) a frame assembly comprising:

(1) a front section having an inner surface and an outer surface, (2) a rear section having an inner surface and an outer surface, wherein between the two inner surfaces is suspended said compound diaphragm, and B. a transducer driver unit which interfaces with said compound diaphragm by means of said center, front and rear electrodes, wherein said unit accepts an incoming audio signal and produces an alternating signal, analogous to the incoming audio signal, which drives said compound diaphragm.

4. An electrolytic loudspeaker assembly comprising:

A. a capacitive transducer comprising:

a) a compound diaphragm further comprising:

(1) a center section having a first side and a second side, wherein attached to the first side is a front section and attached to the second side is a rear section, (2) a center electrode in electrical contact with said center section, a front electrode in electrical contact with said front section, and a rear electrode in electrical contact with the rear section, b) a frame assembly comprising:

(1) a front section having an inner surface and an outer surface, (2) a rear section having an inner surface and an outer surface, wherein between the two inner surfaces is suspended said compound diaphragm, B. an acoustic wave diffuser, reflector and absorbing assembly comprising:

a) a base plate having substantially similar dimensions as said frame assembly and having an outer surface and an inner surface, wherein the inner surface of the base plate is attached to the outer surface of the rear section of said frame assembly by a plurality of standoffs, wherein when said base plate is attached, a space remains between the inner surface of said base plate and the outer surface of the rear section of said frame assembly, and b) an acoustic wave diffusing, reflecting and absorbing structure attached within said space, wherein said structure comprises a plurality of acoustic wave guides having an entrance port and an exit port, wherein said acoustic wave guides are arranged to allow acoustic waves emanating from said electrolytic loudspeaker assembly to be guided through the entrance port and the exit port of said structure, and C. a transducer driver unit which interfaces with said compound diaphragm by means of said center, front and rear electrodes, wherein said unit accepts an incoming audio signal and produces an alternating signal, analogous to the incoming audio diaphragm.

5. The assembly as specified in claim 4 wherein said acoustic wave diffusing, reflecting and absorbing structure further comprises:

a) a rear acoustic wave guide having a first side section, a second side section, an outer surface, an inner surface and an integral and closed, inward protruding center section, wherein the outer surface is attached, by an attachment means, to the inner surface of said base plate, b) a center acoustic wave guide having a first side section, a second side section, an outer surface, an inner surface and an inward protruding central section having a centered vertical slot which functions as a first entrance port, wherein said center acoustic wave guide is attached to said rear acoustic wave guide by a plurality of standoffs, wherein when attached, a first exit port is created on each side section between the inner surface of said rear acoustic wave guide and the outer surface of said center acoustic wave guide, wherein the combination of the respective entrance port and exit port allows the passage of a first group of acoustic waves, and c) a front acoustic wave guide having a first side section, a second side section, an outer surface, an inner surface and a vertically slotted, inward protruding central section which functions as a second entrance port, wherein said front acoustic wave guide is attached to said center acoustic wave guide by a plurality of standoffs, wherein when attached a second exit port is created on each side section between the inner surface of said center acoustic wave guide and the outer surface of said front acoustic wave guide, wherein the combination of the respective entrance port and exit port allows the passages of a second group of acoustic waves, wherein between the inner surface of said front acoustic wave guide and the outer surface of said frame assembly is located a passage which allows the flow of a third group of acoustic waves.

6. The assembly as specified in claim 5 wherein the closed, inward protruding central section can be designed to have a triangular shape or a convex shape.

7. An electrolytic loudspeaker assembly comprising:

A. a capacitive transducer comprising:

a) a compound diaphragm further comprising:

(1) a center section having a first side and a second side, wherein attached to the first side is a front section and attached to the second side is a rear section, (2) a center electrode in electrical contact with said center section, a front electrode in electrical contact with said front section, and a rear electrode in electrical contact with the rear section, b) a frame assembly comprising:

(1) a front section having an inner surface and an outer surface, (2) a rear section having an inner surface and an outer surface, wherein between the two inner surfaces is suspended said compound diaphragm, B. an acoustic baffle structure having at least two acoustic wave impinging baffles that converge outward from/an apex that is attached, by an attachment means, to the rear section of the compound diaphragm of said capacitive transducer, wherein when the acoustic waves emanating from said capacitive transducer impinge upon said at least two baffles they move outward into an audio listening space, and C. a transducer driver unit which interfaces with said compound diaphragm by means of said center, front and rear electrodes, wherein said unit accepts an incoming audio signal and produces an alternating signal, analogous to the incoming audio signal, which drives said compound diaphragm.

8. The assembly as specified in claim 7 wherein said at least two acoustic wave impinging baffles comprise four baffles that extend outward from an apex which is substantially, centered on the rear section of the compound diaphragm of said capacitive transducer.

9. The assembly as specified in claim 7 wherein said at least two acoustic wave impinging baffles comprise four baffles that extend outward from an apex which is located off-center on the rear section of the compound diaphragm of said capacitive transducer.

10. The assembly as specified in claim 7 wherein said apex is attached to a pivoting unit which is attached to the rear section of the compound diaphragm of said capacitive transducer, wherein said pivoting unit allows the baffles to be located at selectable outward extending angles.

* * * * *